United States Patent [19]

King et al.

[11] 4,149,224

[45] Apr. 10, 1979

[54] INSTANT SAVIOR

[76] Inventors: William G. King, c/o George Spector, 3615 Woolworth Bldg., 233 Broadway; George Spector, 3615 Woolworth Bldg., 233 Broadway, both of New York, N.Y. 10007

[21] Appl. No.: 758,466

[22] Filed: Jan. 11, 1977

[51] Int. Cl.[2] ..... F21L 1/00

[52] U.S. Cl. ..... 362/157; 340/565; 340/666; 362/23; 362/458

[58] Field of Search ..... 340/272, 31 R; 200/85 R, 86 R; 177/177, 2, 4; 362/23, 145, 153, 157, 458

[56] References Cited

U.S. PATENT DOCUMENTS

| | | | |
|---|---|---|---|
| 1,411,167 | 3/1922 | Cutshall | 200/86 R |
| 3,169,022 | 2/1965 | Kretsinger | 340/272 |
| 3,509,527 | 4/1970 | Oakes et al. | 200/86 R |
| 4,017,157 | 4/1977 | van Riet | 177/2 |

OTHER PUBLICATIONS

"Popular Mechanics," vol. 101, issue 3, p. 140, pub--Mar. 1954, Deckelmann.

*Primary Examiner*—Samuel W. Engle
*Assistant Examiner*—Ralph Palo

[57] ABSTRACT

A personal security device incorporated into a conventional flashlight for informing a person, by remote control means, who is outside the door of the house, and indicating by a picture, whether it is a man, woman or child, the picture appearing on a view screen of a unit mounted on the flashlight, so that a person is thus cautioned against opening the door, particularly if there is a man outside.

2 Claims, 3 Drawing Figures

INSTANT SAVIOR

This invention relates generally to remote controlled warning devices. Still more specifically it relates to a specialized flashlight.

It is generally well known that in this time of high crime, persons must take greater precautions for their own saftey than in former years long ago, so to not become victims of robbery, rape, or murder. One such precaution is to not open a door of a home if someone is outside whose identity is unknown. There is, accordingly, a need for indicating who may be outside the door, if a person is unable to see who it is.

Therefore, it is a principal object of the present invention to provide an instant saviour device that includes a portable flashlight that is additionally equipped with a unit having a picture screen upon which there will appear a figure for more specifically identifying who may be behind an outside door.

Another object is to provide an instant savior that can be operated from any room in a house wherever a person may be during a day, or in a bedroom at night, so that if he hears a sound from outside the door, he can use the device which operates electrically by remote control means.

Other objects are to provide an instant savior which is simple in design, inexpensive to manufacture, rugged in construction, easy to use and efficient in operation.

These and other objects wll be readily evident upon a study of the following specification and the accompanying drawing wherein.

Figure 1:
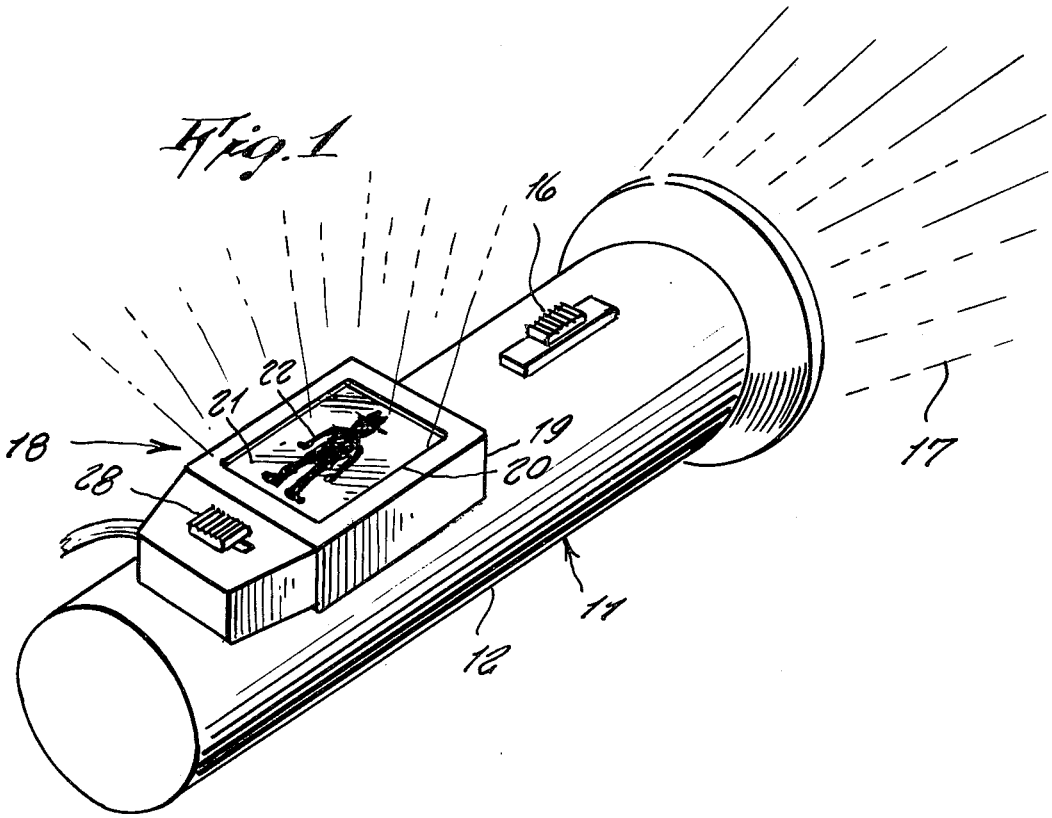
FIG. 1 is a perspective view of a portable flashlight device of the present invention.
Figure 2:
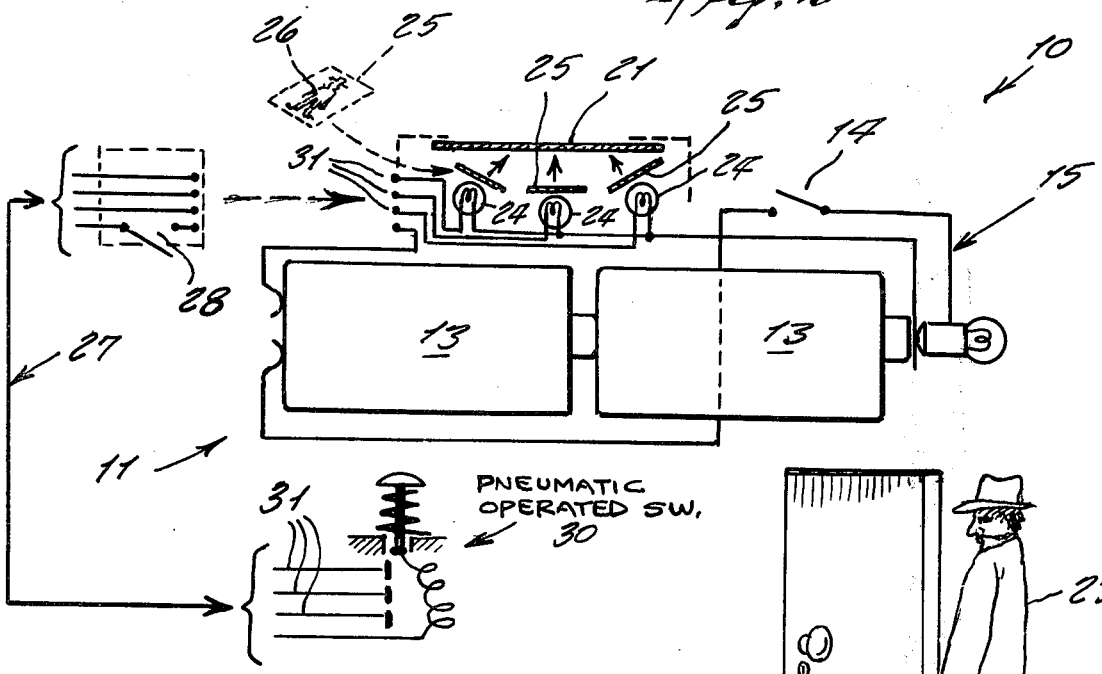
FIG. 2 is an electro-mechanical diagram of the invention.
Figure 3:
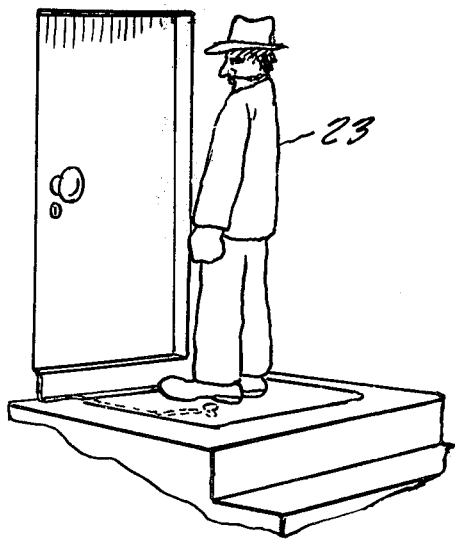
FIG. 3 is a view of a person outside of a house at a door, and who will be more clearly identified without being seen from inside the house, by use of the present invention.

Referring now to the drawing in greater detail, the reference numeral 10 represents an instant savior wherein there is a conventional flashlight 11 including a case 12 containing dry cell batteries 13, an electric lamp at one end and an electric switch 14 in an electric circuit 15 that can be turned on or off by means of exterior push button 16, so that the flashlight can be used in a conventional way to produce light rays 17 for shining at any object in a darkness.

In the present invention, the flashlight is additionally equipped with a unit 18 mounted upon a side of the flashlight case and which utilizes the electrical power from the batteries 13 so to operate. The unit 18 includes a case 19 having a large window 20 fitted with translucent glass 21 so to serve as a screen upon which there may be flashed a picture image 22 representing a person 23 who, unseen, is outside a home door.

The unit includes three lamps 24 behind the glass screen 21, and a transparent glass plate 25 intercepted between each lamp and the screen 21, each plate having a sillouette 26 thereupon one of which represents a man, another a woman and another a child. The lamps 24 are all in an electrical circuit 27 connected to the flashlight batteries 13. A pushbutton 28 of a switch 29 serves to turn on or off the unit 18.

The circuit 27 extends to a mechanical or pneumatic operated switch 30 located under a door mat where it is hidden and which is depressed when stood upon by the person outside the door; the switch having a compression spring that allows the switch button to be depressed downwardly a distance that is in proportion to a weight of the individual thereupon, it being understood that men generally weigh more than woman, and children the least, so that the switch button thus selectively closes either one of circuit lines 31 extending to the different lamps 24.

Thus in operative use when the pushbutton 28 is depressed by a person at home, in response to a noise or knock outside a house door he can more clearly identify the individual outside categorically without being able to see him. The instant savior can be used at night operated from a bed if wished, and does not require any lights outside shining on the stranger at the door, but will work in total darkness as well as during a day light.

It should be understood that additional switches 30 may be positioned elsewhere around a property of a private home, so that any noise elsewhere can thus be checked out so to see if there is a prowler such as at night. Such instant savior for greater efficiency could employ an additional lamp 24 and line 31 so to pick up small light-weight animals such as cats, dogs, or wildlife animals such as racoons, who may be prowling around a house and who make noise which otherwise might be suspected as being made by a prowling person. Thus a person at home can feel more safe by identifying who is making the noise outside.

While various changes may be made in the detail construction, it is understood that such changes will be within the spirit and scope of the present invention, as is defined by the appended claims.

What is claimed is:

1. A unit for identifying the size of an intruder in combination with a portable flashlight, including a case containing dry cell batteries, a lamp and a switch in a circuit, said device comprising an identifying unit mounted upon a side of said flashlight having a translucent window which serves as a screen for projection thereon of a plurality of images, means within said unit for selectively projecting each of said images on said screen in further combination with a variable weight responsive switch externally remote from said case, electrically connected to said unit, said unit being electrically connected to said circuit, wherein the said weight responsive switch includes a plurality of positions, each corresponding to the projection by said means of a selected image on said screen, wherein each said position corresponds to a predetermined weight acting upon said weight responsive switch.

2. The combination set forth in claim 1, wherein said means includes several lamps inside said unit behind said glass screen, a transparent plate between each said lamp and said glass screen, having a different silouette on each said plate, each said lamp being on a separate parallel circuit line with said batteries and one of said switch positions wherein actuation of second said switch to each of said positions corresponding to action of a predetermined weight on said second switch causes projection of a selected image on said screen simultaneously with actuation of said lamp.

* * * * *